US011448055B2

(12) United States Patent
Wright

(10) Patent No.: US 11,448,055 B2
(45) Date of Patent: Sep. 20, 2022

(54) SUBSEA DUPLEX PUMP, SUBSEA PUMPING SYSTEM, AND SUBSEA PUMPING METHOD

(71) Applicant: David C. Wright, Magnolia, TX (US)

(72) Inventor: David C. Wright, Magnolia, TX (US)

( * ) Notice: Subject to any disclaimer, the term of this patent is extended or adjusted under 35 U.S.C. 154(b) by 0 days.

(21) Appl. No.: 17/610,345

(22) PCT Filed: May 16, 2019

(86) PCT No.: PCT/US2019/032666

§ 371 (c)(1),
(2) Date: Nov. 10, 2021

(87) PCT Pub. No.: WO2020/231438

PCT Pub. Date: Nov. 19, 2020

(65) Prior Publication Data

US 2022/0145744 A1 May 12, 2022

(51) Int. Cl.
*E21B 43/01* (2006.01)
*E21B 43/36* (2006.01)

(52) U.S. Cl.
CPC ..... *E21B 43/36* (2013.01); *E21B 43/01* (2013.01)

(58) Field of Classification Search
CPC ..... E21B 43/01; E21B 43/36
See application file for complete search history.

(56) References Cited

U.S. PATENT DOCUMENTS 4,981,175 A 1/1991 Powers
5,482,117 A 1/1996 Kolpak et al.
5,490,562 A 2/1996 Arnold
5,693,125 A 12/1997 Dean
6,102,673 A 8/2000 Mott et al.
6,364,940 B1 4/2002 Prueter et al.
6,592,334 B1 7/2003 Butler
6,663,361 B2 12/2003 Kohl et al.
8,770,950 B2 7/2014 Biester
9,004,166 B2 4/2015 Raglin
9,656,800 B2 5/2017 Donahue et al.
(Continued)

OTHER PUBLICATIONS

International Search Report and Written Opinion of the International Searching Authority, issued by the U.S. Patent & Trademark Office in PCT/2019/032666 dated Jul. 25, 2019 (14 pages).

*Primary Examiner* — Matthew R Buck
(74) *Attorney, Agent, or Firm* — Matthews, Lawson, McCutcheon & Joseph, PLLC

(57) ABSTRACT

A subsea pump includes a liquid-gas inlet port for receiving liquid and gas into a first chamber, a plunger in a second chamber, a suction valve communicating the first chamber with a second chamber, a gas discharge conduit, a gas discharge valve communicating the first chamber with the gas discharge conduit, and a liquid discharge port for discharging liquid from the second chamber. The plunger retracts inwardly to create a vacuum in the second chamber that opens the suction valve and pulls liquid from the first chamber into the second chamber. The plunger extends outwardly against the suction to cause the suction valve to close and create a positive pressure that opens the gas discharge valve and forces the gas in the first chamber through the gas discharge valve into the gas discharge conduit. Liquid in the second chamber is discharged through the liquid discharge port via the positive pressure.

11 Claims, 6 Drawing Sheets

(56) References Cited

U.S. PATENT DOCUMENTS

| | | | | |
|---|---|---|---|---|
| 2003/0205384 | A1 | 11/2003 | Lush et al. | |
| 2015/0104328 | A1 | 4/2015 | Babbitt et al. | |
| 2016/0145980 | A1 | 5/2016 | Cunningham et al. | |
| 2016/0369610 | A1* | 12/2016 | Wright | E21B 3/02 |

* cited by examiner

SUBSEA DUPLEX PUMP, SUBSEA PUMPING SYSTEM, AND SUBSEA PUMPING METHOD

CROSS REFERENCE TO RELATED APPLICATIONS

This application is a United States national stage application, claiming priority to International Patent Application No. PCT/US2019/032666, filed on May 16, 2019, filed under 35 U.S.C. § 371 and which is hereby incorporated by reference herein in its entirety.

BACKGROUND

1. Field of the Invention

The present disclosure relates to a duplex pump for subsea applications. In particular, the disclosure relates to a subsea duplex pump that separates gas and liquid entering the duplex pump, and that discharges the separated gas and liquid through respective discharge ports. The present disclosure also relates to subsea pumping systems and methods implementing the subsea duplex pump. The duplex pump, systems and methods can, in some embodiments, be for CHRS (Chemical Injection and Hydrate Remediation and Separation) operations to be deployed from a skid which is located underneath a remotely operated vehicle (ROV) in subsea applications.

2. Description of Related Art

In petroleum production, oil and its byproducts are typically removed from wells and transported through pipelines, including subsea pipelines. Depending on the activity, fluid may be directed through subsea flowlines located on the seafloor or directed upwardly from a subsea well, pipe, vessel, or other container to the water surface. Typically, subsea pumps are used to direct subsea fluids from one location to another. In petroleum production, oil and its byproducts are typically removed from wells and transported through pipelines, including subsea pipelines. The flow of oil and other fluids through a subsea pipeline can lead to the buildup of different substances within the pipe impeding fluid flow therethrough. For example, scale, paraffin wax, gas hydrates, debris or sand may buildup in the pipeline over time depending on the nature of the fluid flowing through the pipeline and other surrounding circumstances.

A conventional way to prevent the formation of paraffin deposits is to heat the pipelines. That method, however, may be expensive and may not be feasible for subsea pipelines submerged in the cold sea water. Another method involves "pigging", wherein a mechanical device is passed through the pipeline scraping the inner wall of the pipeline and pushing paraffin deposits through. A further method for removing paraffin deposits is "hot oiling," wherein a heated oil is pumped through the pipeline in order to remove the paraffin wax deposits. These methods are cumbersome and expensive for subsea pipelines.

Blockage in subsea pipelines may also result from the formation of gas hydrates where an aqueous phase is inherently present, during the transportation of fluids including gases. This is a common problem, especially in deep sea conditions in which the environment includes low temperatures. The low temperatures and the presence of water lead to formation of gas hydrates in the pipelines. A conventional method of dealing with gas hydrates is to insulate the pipeline. However, that approach is typically expensive. Another method is to pump methanol through the pipeline or use chemical methods such as addition of anti-agglomerates (e.g. kinetic inhibitors or thermodynamic inhibitors). To be effective, however, large quantities of these chemicals are required, making the process expensive.

Other methods involve chemical stimulation and depressurization of the pipeline. Those methods typically involve pumps and chemical reservoirs mounted on a subsea skid system, which rests on the seafloor. As subsea pipelines can be located in very deep water (up to 10,000 feet), these pipelines can typically be accessed through remotely operated vehicles ("ROV's"), which are also responsible for setting up the skid systems and connecting the remediation to the subsea pipeline.

Some subsea remediation systems are operated solely through ROVs. Those systems use a separate liquid/gas separator device in addition to one or more pumps for depressurizing the production pipeline.

A need exists for an integrated, all-in-one subsea remediation system that eliminates the separate liquid/gas separator device.

Embodiments of the present disclosure, described herein, meet these needs.

SUMMARY

The present application is directed to a subsea duplex pump, systems and methods.

In a preferred embodiment, a subsea pump comprise: a first chamber; a liquid-gas inlet port for receiving liquid and gas into the first chamber; a second chamber; at least one plunger in the second chamber, the at least one plunger configured to expand outwardly and retract inwardly; at least one suction valve communicating the first chamber with the second chamber; a gas discharge conduit; at least one gas discharge valve communicating the first chamber with the gas discharge conduit; and at least one liquid discharge port for discharging liquid from the second chamber. The at least one plunger retracts inwardly to create a vacuum in the second chamber that opens the at least one suction valve and pulls liquid from the first chamber into the second chamber, and wherein the plunger extends outwardly against the suction to cause the at least one suction valve to close and to create a positive pressure that opens the at least one gas discharge valve and forces the gas that is in the first chamber through the at least one gas discharge valve and into the gas discharge conduit. Further, the liquid in the second chamber is discharged through the at least one liquid discharge port via the positive pressure.

In an embodiment, the subsea pump further comprises a pump packing in the second chamber; and two plungers, wherein each of the plungers extends outwardly from a side of the pump packing and retracts inwardly toward the side of the pump packing.

In an embodiment, the pump packing is driven by a pony rod to retract and extend the plungers.

In an embodiment, the subsea pump comprises a set of two or more suction valves.

In an embodiment, the subsea pump comprises a set of two or more gas discharge valves.

In an embodiment, a back flow prevention device is provided for at least one of the at least one liquid discharge port, the gas discharge conduit, and the liquid-gas inlet port.

In an embodiment, the subsea pump further comprises an internal flow sensor that indicates when at least the liquid in the first chamber has risen to a predetermined level at which the at least one plunger should retract to open the at least one suction valve and pull the liquid from the first chamber into the second chamber.

In an embodiment, the at least one suction valve is provided internally of the subsea pump and between the at least one plunger and the at least one gas discharge valve.

In an embodiment, the at least one suction valve is provided on a side wall of the subsea pump.

In another embodiment, a subsea pumping method comprises: connecting a subsea pump to a subsea fluid-and-gas source, the subsea pump comprising a liquid-gas inlet port for receiving liquid and gas into a first chamber of the subsea pump, a plunger in a second chamber in the subsea pump; a suction valve communicating the first chamber with the second chamber; a gas discharge valve communicating the first chamber with a gas discharge conduit; and allowing fluid and gas from the subsea fluid-and-gas source to flow through the liquid-gas inlet port and into the first chamber; driving the subsea pump to make the plunger retract inwardly to create a vacuum in the second chamber that opens the suction valve and pulls liquid from the first chamber into the second chamber; and driving the subsea pump to make the plunger extend outwardly against the suction to cause the suction valve to close and to create a positive pressure that opens the gas discharge valve and forces the gas that is in the first chamber through the gas discharge valve and into the gas discharge conduit, wherein the liquid in the second chamber is discharged through a liquid discharge port of the subsea pump via the positive pressure.

In an embodiment, the method further comprises: transporting the gas from the gas discharge conduit to a surface facility via a gas line connected to the subsea pump; and transporting the liquid from the liquid discharge port to the surface facility via a liquid line connected to the subsea pump.

In an embodiment, the method is for subsea hydrate recovery or remediation, plug remediation, dewatering purposes, flushing purposes, cleaning purposes, evacuation purposes, recovery purposes, and combinations thereof.

BRIEF DESCRIPTION OF THE DRAWINGS

Various embodiments are hereafter described in detail and with reference to the drawings wherein like reference characters designate like or similar elements throughout the several figures and views that collectively comprise the drawings.

DETAILED DESCRIPTION

Before explaining the disclosed embodiments in detail, it is to be understood that the present disclosure is not limited to the particular embodiments depicted or described, and that the invention can be practiced or carried out in various ways. The disclosure and description herein are illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. Further, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings to be illustrative and non-limiting, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
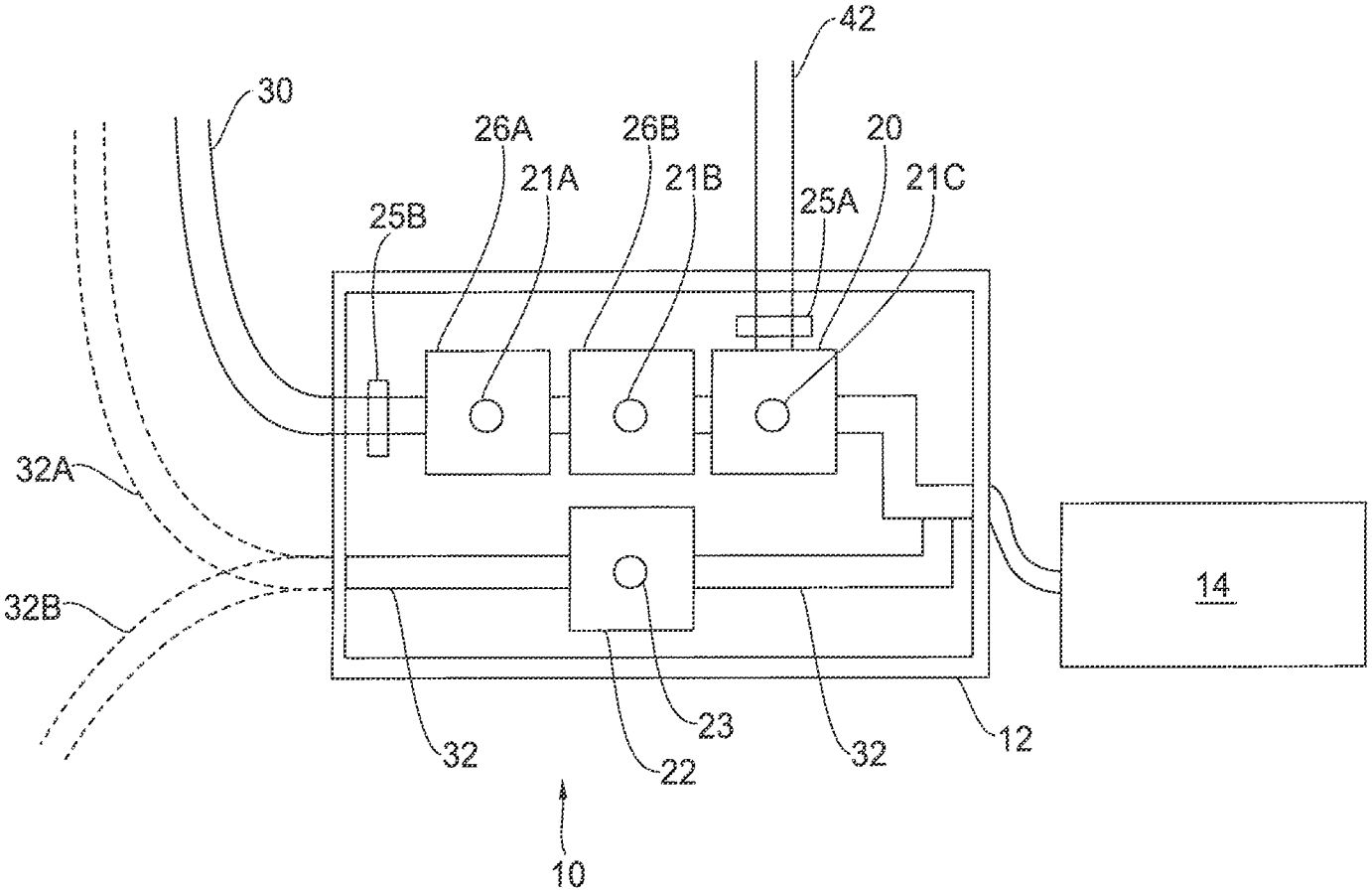
FIG. 1 depicts a schematic of a subsea system including a subsea duplex pump.

FIG. 1 shows one example of an application in which the subsea duplex pump may be used. This example, which illustrates subsea system 10 enclosed in a skid frame 12, is not limiting. The subsea pump may be used in other applications, such as at the surface, and without a skid. In FIG. 1, the skid frame 12 that comprises a universal mounting system which can fit any work-class of ROV. The apparatus may be directly mounted to the skid or may be a remote system, which can be connected to the skid through interface lines (e.g., a "belly pack"). The system 10 is placed in fluid communication with a subsea pipeline through a Pipeline End Termination (PLET) 14, a standard form of closure known in the art. The PLET 14 is a structure that provides a pipeline connection to the system 10 components. A suitable PLET 14 may include a foundation that vertically supports a pipeline, the weight of one or more end connectors, and any valves employed. The PLET 14 may also include a hub connector, a vertical connector or similar device operationally configured to act as a tie-in connection between the pipeline and the subsea system 10 components. As shown in FIG. 1 the PLET 14 is connected through the frame 12 to a duplex pump 20, which is discussed in further detail below.

In the non-limiting embodiment, one or more series pumps 26A, 26B are connected to the duplex pump 20A to motivate produced fluid. The duplex pump 20 and the series pumps 26A, 26B may be powered by a respective one of a plurality of hydraulic connections 21A, 21B, and 21C to the ROV, which can act as the prime mover. While two series pumps 26A, 26B are depicted in the illustrated embodiment, it can be appreciated that other embodiments may have one, three, four, or more series pumps 26A, 26B capable of depressurizing the production pipeline. In an embodiment, the series pumps 26A, 26B can be high flow pumps that are capable of 30-50 gpm (gallons per minute) pump capacity. Depressurization may reach 100 psig (pounds per square inch gauge) at a depth of 10,000 ft.

The duplex pump 20 and the series pumps 26A, 26B can be activated with the use of hydraulic fluid from an ROV through hydraulic connections 21A-21C. Once activated, the duplex pump 20 and the series pumps 26A, 26B act to depressurize the pipeline through the PLET 14, which assists in the extraction of hydrate plugs. In addition to the depressurization, additional remediation of hydrate plugs may be effected by a chemical pump 22. The chemical pump 22 may inject any suitable hydrate solvent (e.g., alcohol, glycol) into the pipeline through the PLET 14 to further assist in the break-up of hydrate plugs. The chemical pump 22 is supplied through chemical conduit 32, which may optionally rise to the surface 32A to connect to a production distribution system, or may be supplied through a seafloor bladder or other suitable supply 32B. (Both possibilities are depicted as broken lines). In an embodiment, the chemical pump 22 can be powered by the ROV through a hydraulic connection 23. All fluid extracted from the pipeline is discharged at the surface through conduits 30 and 42, as discussed below.

Although not necessarily limited to a particular type of connection, each of the conduits 30 and 42 are suitably joined to a pump (e.g., pump 20 and series pump 26A) via emergency quick disconnects 25A, 25B, commonly referred to as "hot stabs" by persons of ordinary skill in the art of subsea pumping operations. In one aspect, suitable emergency quick disconnects 25A, 25B are operationally configured to prevent ambient water ingress into the respective pump during system 10 operation. In another aspect, the emergency quick disconnects 25A, 25B are operationally configured to allow the conduits 30 and 42 to release from the respective pump, allowing the conduits 30 and 42 to release from the skid frame 12. In operation, the emergency quick disconnects 25A are operationally configured to release the attached conduit, e.g., via an electric signal or an acoustic signal initiated from the surface. Although the system 10 may be built to scale, including the emergency quick disconnects 25A, suitable disconnects range in size from about 5.08 cm to about 10.16 cm (about 2.0 inches to about 4.0 inches).

Figure 2:
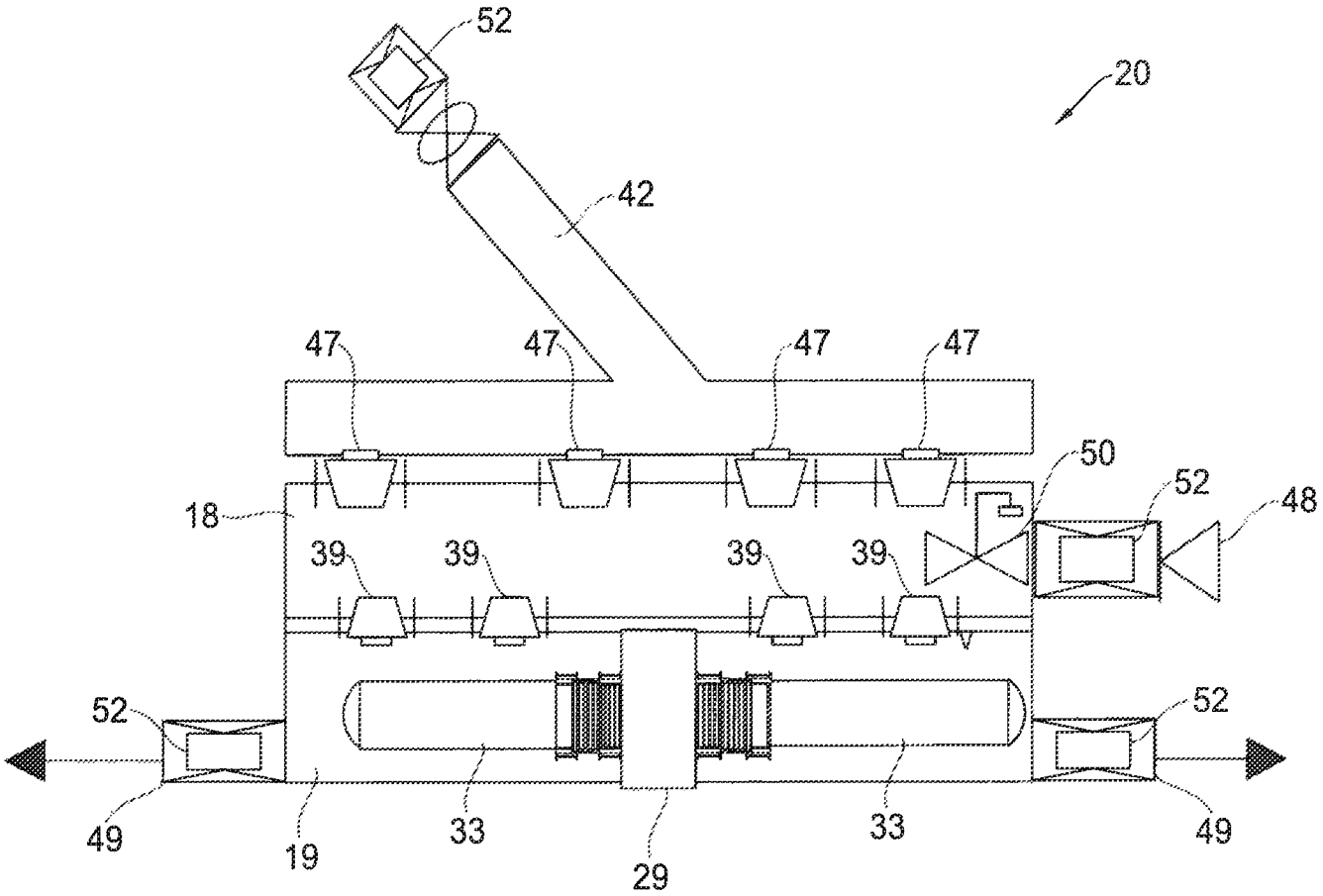
FIG. 2 illustrates an embodiment of a subsea duplex pump.

An example of the duplex pump 20 is shown in cross-section in FIG. 2. The duplex pump 20 is a subsea pump. The duplex pump 20 includes a first chamber 18 and a second chamber 19. A pump packing 29 is provided in the second chamber 19, and may, in an embodiment, be driven by a hydraulic connection 21A. Two plungers 33 are located in the second chamber 19, with one plunger 33 on each side of the pump packing 29. Each of the plungers 33 is configured to extend outwardly away from a respective side of the pump packing 29, and to retract inwardly toward the respective side of the pump packing 29 upon actuation of the pump packing 29. Actuation of the pump packing 29 may be made via a pony rod (not shown) that may be driven by the hydraulic connection 21A to retract and extend the plungers 33. While FIG. 2 shows two plungers 33, the duplex pump 20 may include only one plunger 33 in another embodiment, and may include more than two plungers 33 in a further embodiment. The size of the plungers 33 is not particularly limiting, although in a preferred embodiment the plungers 33 may have a diameter in the range of 2.5 inches to 4 inches.

In one embodiment, a set of suction valves 39 may be provided between the first chamber 18 and the second chamber 19 to create a closable path from the second chamber 19 to the first chamber 18. While FIG. 2 shows a set of four suction valves 39, the set may have a different number of suction valves 39, such as one, two, three, or more than four suction valves 39. The duplex pump 20 also includes a gas discharge conduit 42, which in the illustrated embodiment is located on a top portion of the duplex pump 20. A set of gas discharge valves 47 is provided between the first chamber 18 and the gas discharge conduit 42 to as to create a closable path from the first chamber 18 to the gas discharge conduit 42. The gas discharge conduit 42 proceeds upward to the sea surface where the gas can be removed or vented. In an embodiment, an emergency quick disconnect 25A can allow rapid disconnection of the system 10 from the gas discharge conduit 42. While FIG. 2 shows a set of four gas discharge valves 47, the set may have a different number of gas discharge valves 47, such as one, two, three, or more than four gas discharge valves 47.

A liquid-gas inlet port 48 is provided on the first chamber 18 for receiving liquid and gas into the first chamber 18 from the PLET 14. At least one liquid discharge port 49 is provided on the second chamber 19 for discharging liquid from the second chamber 19. For instance, in the example of FIG. 1, the liquid is discharged from the second chamber 19 to the series pumps 26A, 26B, which in turn move the liquid to a liquid return line 30 in an exemplary embodiment. The liquid return line 30 conveys the liquid to the surface. The operation of the duplex pump 20 is as follows. Liquid and gas is received into the first chamber 18 from the PLET 14. Due to the higher density and specific gravity, the liquid component more readily sinks to the bottom of the first chamber 18, while due to the lower density and specific gravity, the gas rises to the top of the first chamber 18. The hydraulic connection 21A actuates the pump packing 29 so that each plunger 33 on the pump packing 29 retracts inwardly toward the pump packing 29 to create a vacuum in the second chamber 19 that opens the suction valves 39. The vacuum pulls liquid from near the bottom of the first chamber 18 through the open suction valves 39 and into the second chamber 19, thus separating the liquid from the gas in the liquid-gas mixture provided to the first chamber 18 from the PLET 14 through the liquid-gas inlet port 48. The separated gas from the liquid-gas mixture at this time remains in the first chamber 18. The pump packing 29 is then actuated so that each plunger 33 on the pump packing 29 extends outwardly away from the pump packing 29 and against the suction created by the vacuum to cause the suction valves 39 to close. At the same time, the outward extension of the suction valves 39 creates a positive pressure in the first chamber 18 that opens the gas discharge valves 47. The positive pressure forces the separated gas in the first chamber 18 through the gas discharge valves 47 and into the gas discharge conduit 42. The gas discharge conduit 42 feeds the gas to the gas conduit 42, serving as a return line for the gas recovered from the PLET 14. Further, the positive pressure created by the plungers 33 also produces a force that discharges the separated liquid in the second chamber 19 through the liquid discharge port 49 and out of the second chamber 19 (e.g., to the series pumps 26A, 26B).

Because the duplex pump 20 provides the dual function of (1) separating the gas from the liquid in the liquid-gas mixture received from the fluid source; and (2) distributing the separated gas and liquid to respective return lines, there is no need for a separate separator device between the duplex pump 20 and the subsea fluid source. The duplex pump 20 may thus be directly connected to the PLET 14, as shown for example in the non-limiting embodiment of FIG. 1.

Figure 3:
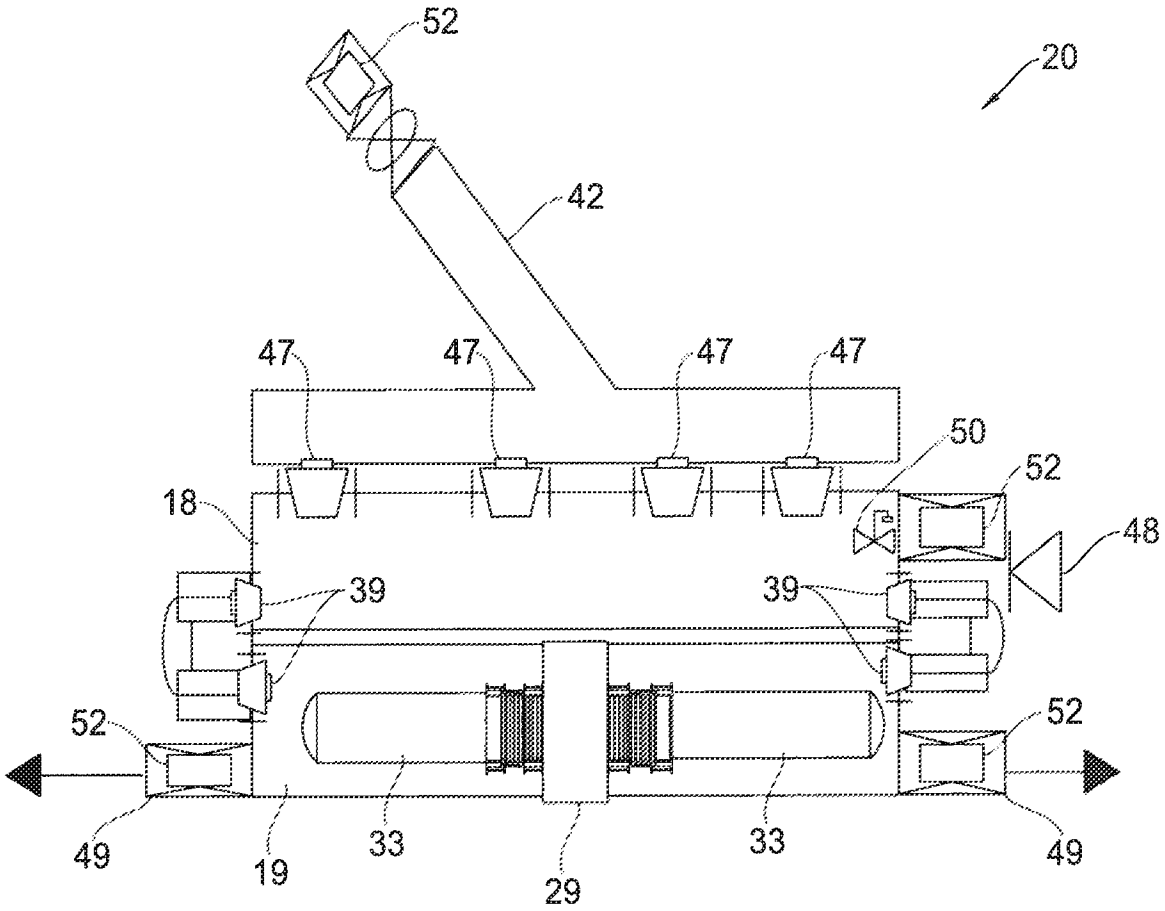
FIG. 3 illustrates another embodiment of a subsea duplex pump.

FIG. 2 shows the suction valves 39 provided internally of the duplex pump 20 and between the plungers 39 and the gas discharge valves 47. In a preferred embodiment, as shown in FIG. 3, the suction valves 39 are provided on a side wall of the duplex pump 20. For instance, a pair of connected suction valves 39 may be provided on the side wall of the duplex pump 20 such that one suction valve 39 in the connected pair opens to the first chamber 18 and the other suction valve 39 in the pair opens to the second chamber 19. This configuration may be easier to build, and may be more cost effective because the suction valves 39 can be easily accessed for maintenance and/or replacement without having to open the duplex pump 20 to access the interior thereof.

In each embodiment illustrated in FIGS. 2 and 3, one or more of the liquid discharge port 49 the gas discharge conduit 42, and the liquid-gas inlet port 48 may be provided with a back flow prevention device 52. In addition, an internal flow sensor 50 may be provided in the first chamber 18 to indicate when at least the liquid in the first chamber 18 has risen to a predetermined level, at which the pump packing 29 should be actuated to retract the plungers 39 and open the suction valves 39 to pull the liquid from the first chamber 18 into the second chamber 19. Further, in some embodiments, the first chamber 18 may include a screen, acting as a filter, to catch debris from flowing with the separated liquid and/or gas.

Figure 4:
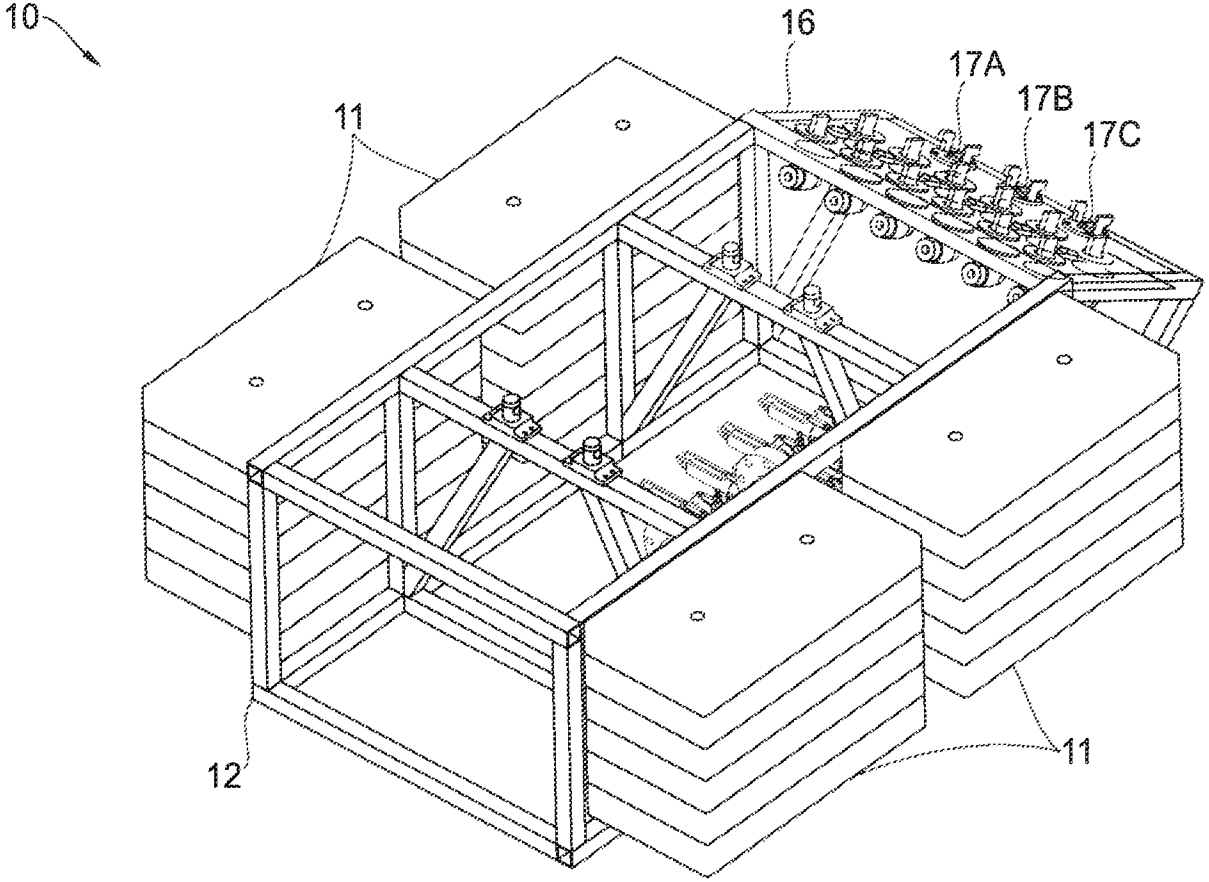
FIG. 4 depicts a perspective view of the subsea system including a subsea duplex pump.

Turning now to FIG. 4, a perspective view of an embodiment of the system 10 is shown in greater detail. Fluid flow within the system 10 is provided via conduits, which may include conventional metal piping including coiled tubing, flexible hose, flexible piping, and combinations thereof. In this embodiment, the conduits between the components are not shown for clarity. The system 10 is depicted with frame 12 comprising a plurality of flotation buoys 11 which counteract the weight of the system 10 and provide for easier mobility for attachment to the ROV. Hydraulic conduits 17A, 17B, and 17C may be configured on a manifold 16 for use with a suitable ROY for establishing multiple fluid paths to and from the PLET 14 (as depicted in FIG. 1). For example, one conduit may be dedicated to extraction of produced fluid, another to the injection of chemical stimulants, and still another for hydraulic control of the entire system by the ROV.

Figure 5:
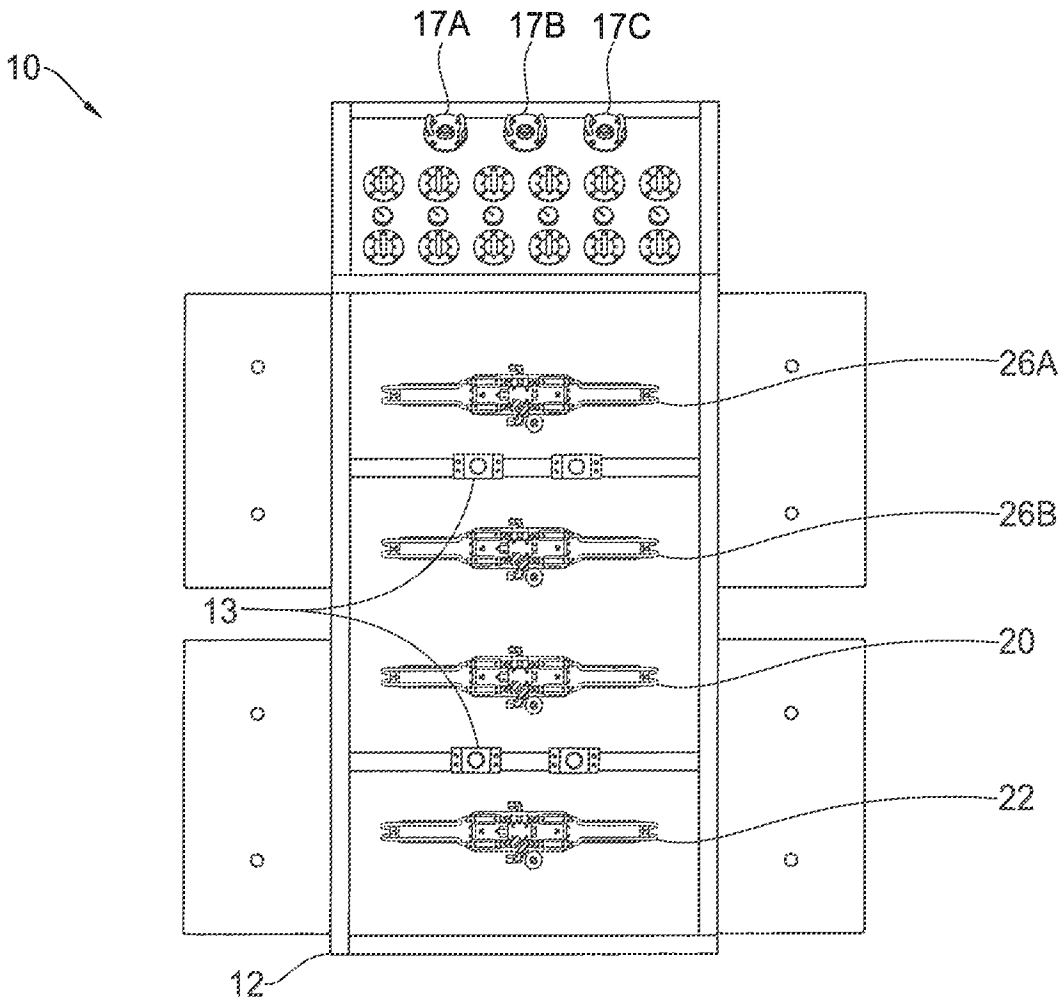
FIG. 5 depicts a top view of the subsea system including a subsea duplex pump.
Figure 7:
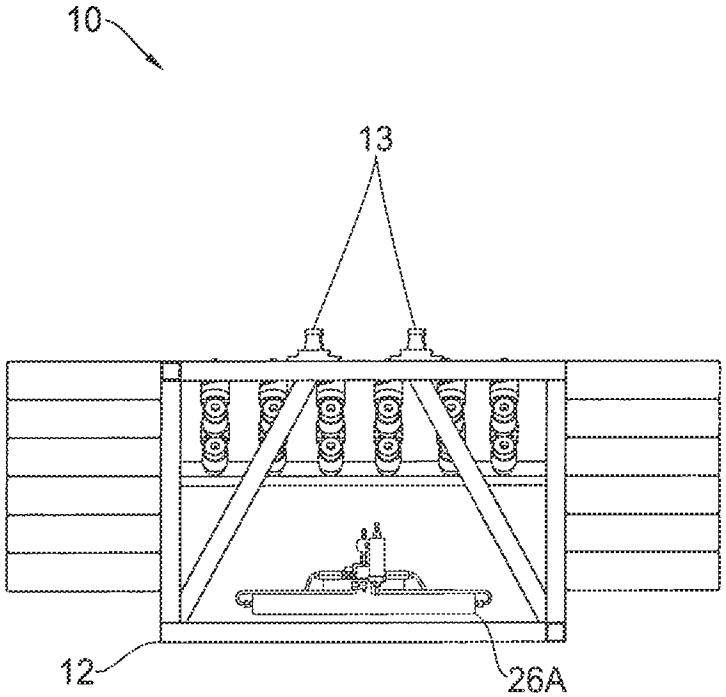
FIG. 7 depicts a front view of the subsea system including a subsea duplex pump.
Figure 6:
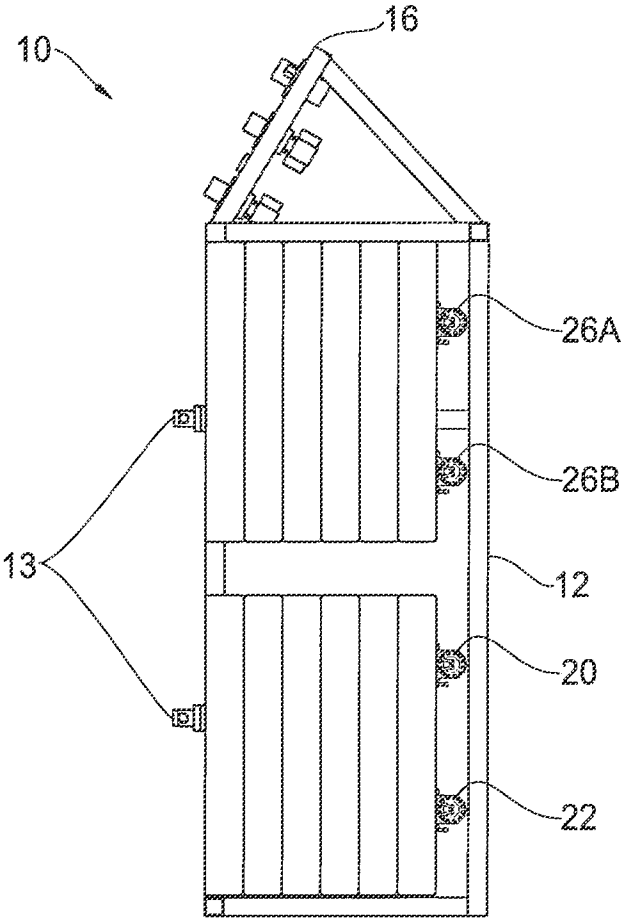
FIG. 6 depicts a side view of the subsea system including a subsea duplex pump.

FIG. 5 depicts an overhead view of the embodiment of system 10 depicted in FIG. 4. This view also shows frame 12, hydraulic conduits 17A-C, and latches 13 for connection with a suitable ROV (not shown). This overhead view also shows the duplex pump 20, the series pumps 26A, 26B and the chemical pump 22. The conduits between these components are omitted for clarity in FIG. 4 and FIG. 5. FIGS. 6 and 7 illustrate an exemplary side view and rear view, respectively, of the system 10. FIGS. 6 and 7 further illustrate the relationship of the latches 13 with the frame 12.

The subsea pump of the present application may be operationally configured for subsea hydrate recovery or remediation, plug remediation, dewatering purposes, flushing purposes, cleaning purposes, evacuation purposes, recovery purposes, and combinations thereof. In a particularly advantageous embodiment, the subsea pump may be operationally configured for use in deep water or ultra-deep water environments.

Although several preferred embodiments have been illustrated in the accompanying drawings and describe in the foregoing specification, it will be understood by those of skill in the art that additional embodiments, modifications and alterations may be constructed from the principles disclosed herein.

What is claimed is:

1. A subsea pump comprising:

a first chamber;

a liquid-gas inlet port for receiving liquid and gas into the first chamber;

a second chamber;

at least one plunger in the second chamber, the at least one plunger configured to expand outwardly and retract inwardly;

at least one suction valve communicating the first chamber with the second chamber;

a gas discharge conduit;

at least one gas discharge valve communicating the first chamber with the gas discharge conduit; and at least one liquid discharge port for discharging liquid from the second chamber, wherein the at least one plunger retracts inwardly to create a vacuum in the second chamber that opens the at least one suction valve and pulls liquid from the first chamber into the second chamber, and wherein the plunger extends outwardly against the suction to cause the at least one suction valve to close and to create a positive pressure that opens the at least one gas discharge valve and forces the gas that is in the first chamber through the at least one gas discharge valve and into the gas discharge conduit, and wherein the liquid in the second chamber is discharged through the at least one liquid discharge port via the positive pressure.

2. The subsea pump according to claim 1, further comprising:

a pump packing in the second chamber; and two plungers, wherein each of the plungers extends outwardly from a side of the pump packing and retracts inwardly toward the side of the pump packing.

3. The subsea pump according to claim 2, wherein the pump packing is driven by a pony rod to retract and extend the plungers.

4. The subsea pump according to claim 1, comprising a set of two or more suction valves.

5. The subsea pump according to claim 1, comprising a set of two or more gas discharge valves.

6. The subsea pump according to claim 1, further comprising an internal flow sensor that indicates when at least the liquid in the first chamber has risen to a predetermined level at which the at least one plunger should retract to open the at least one suction valve and pull the liquid from the first chamber into the second chamber.

7. The subsea pump according to claim 1, wherein the at least one suction valve is provided internally of the subsea pump and between the at least one plunger and the at least one gas discharge valve.

8. The subsea pump according to claim 1, wherein the at least one suction valve is provided on a side wall of the subsea pump.

9. A subsea pumping method comprising:

connecting a subsea pump to a subsea fluid-and-gas source, the subsea pump comprising a liquid-gas inlet port for receiving liquid and gas into a first chamber of the subsea pump, a plunger in a second chamber in the subsea pump; a suction valve communicating the first chamber with the second chamber; a gas discharge valve communicating the first chamber with a gas discharge conduit; and allowing fluid and gas from the subsea fluid-and-gas source to flow through the liquid-gas inlet port and into the first chamber;

driving the subsea pump to make the plunger retract inwardly to create a vacuum in the second chamber that opens the suction valve and pulls liquid from the first chamber into the second chamber; and driving the subsea pump to make the plunger extend outwardly against the suction to cause the suction valve to close and to create a positive pressure that opens the gas discharge valve and forces the gas that is in the first chamber through the gas discharge valve and into the gas discharge conduit, wherein the liquid in the second chamber is discharged through a liquid discharge port of the subsea pump via the positive pressure.

10. The subsea pumping method according to claim 9, further comprising:

transporting the gas from the gas discharge conduit to a surface facility via a gas line connected to the subsea pump; and transporting the liquid from the liquid discharge port to the surface facility via a liquid line connected to the subsea pump.

11. The subsea pumping method according to claim 9, wherein the method is for subsea hydrate recovery or remediation, plug remediation, dewatering purposes, flushing purposes, cleaning purposes, evacuation purposes, recovery purposes, and combinations thereof.

* * * * *